US006341955B1

(12) United States Patent
Ueno et al.

(10) Patent No.: US 6,341,955 B1
(45) Date of Patent: Jan. 29, 2002

(54) SEALING APPARATUS IN CONTINUOUS HEAT-TREATMENT FURNACE AND SEALING METHOD

(75) Inventors: Naoto Ueno; Sachihiro Iida; Ichiro Samejima, all of Chiyoda (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/413,806

(22) Filed: Oct. 7, 1999

(30) Foreign Application Priority Data

Oct. 23, 1998 (JP) ..... 10-302512

(51) Int. Cl.[7] ..... F27D 1/18

(52) U.S. Cl. ..... 432/242; 432/8; 432/59; 34/242; 277/413

(58) Field of Search ..... 432/242, 8, 59; 34/242; 277/301, 413

(56) References Cited

U.S. PATENT DOCUMENTS

| | | | | |
|---|---|---|---|---|
| 2,367,174 A | | 8/1945 | Renkin | |
| 3,306,594 A | * | 2/1967 | Bauer | 432/8 |
| 4,102,279 A | * | 7/1978 | Groschl et al. | 110/234 |
| 4,165,964 A | * | 8/1979 | Yonezawa et al. | 432/59 |
| 4,610,860 A | * | 9/1986 | Mullen | 423/447.8 |
| 4,760,995 A | * | 8/1988 | Fukuda et al. | 266/103 |

FOREIGN PATENT DOCUMENTS

| | | | |
|---|---|---|---|
| DE | 579 994 C | | 6/1934 |
| EP | 0 291 952 A | | 11/1988 |
| EP | 0 535 439 A | | 4/1993 |
| FR | 2 282 472 A | | 3/1976 |
| JP | B2-55-1969 | | 1/1980 |
| JP | A-59-133330 | | 7/1984 |
| JP | Y2-63-19316 | | 5/1988 |
| JP | 405086472 A | * | 4/1993 |
| JP | A-5-125451 | | 5/1993 |
| JP | A-6-346156 | | 12/1994 |

* cited by examiner

*Primary Examiner*—Jiping Lu
(74) *Attorney, Agent, or Firm*—Oliff & Berridge, PLC

(57) ABSTRACT

A seal roll apparatus and method hermetically seals boundaries between a plurality of heat-treating sections for continuously heating and cooling a strip material in a continuous heat-treatment furnace. The seal roll apparatus includes a seal roll room including at least a pair of water-cooled seal rolls opposed to each other with a gap therebetween for passing the strip material, and partitions having an opening for passing the strip material, a partition being provided at the inlet side and at the outlet side of the seal rolls.

12 Claims, 5 Drawing Sheets

SEALING APPARATUS IN CONTINUOUS HEAT-TREATMENT FURNACE AND SEALING METHOD

BACKGROUND OF THE INVENTION

1. Field of Invention

The present invention relates to a seal roll apparatus for preventing atmospheric gases from leaking out of the heat treatment zone in a continuous heat-treatment furnace for continuously heat-treating a workpiece strip, such as a steel strip or an aluminum strip, and to a sealing method.

2. Description of Related Art

A continuous heat-treatment furnace basically includes a heating zone in which a workpiece strip is heated to a predetermined temperature for annealing treatment and a cooling zone in which the annealed workpiece is cooled down to room temperature. FIG. 3 is a diagram showing a typical example of a continuous heat-treatment furnace for a cold-rolled steel strip. The following elements are disposed in the continuous heat-treatment furnace in the following order: a pre-heating section 15 for pre-heating a steel strip S by recovering and heat-exchanging usable heat of exhaust gases from a heating section 14, the heating section 14 for heating the steel strip S to a predetermined temperature, a soaking section 16 for soaking the steel strip S which has been heated to the predetermined temperature, a slow-cooling section 17 for slow-cooling the soaked steel strip S, a rapid-cooling section 18 for rapid-cooling the slow-cooled steel strip S, an over-aging section 19 for over-aging treatment, and a final cooling section 20 for finally cooling the steel strip S down to room temperature. The pre-heating section 15, the heating section 14, and the soaking section 16 constitute a heating zone, and the slow-cooling section 17 through the final cooling section 20 constitute a cooling zone.

The cold-rolled steel strip S which has been subjected to work hardening is passed through the individual treatment sections by a hearth roll 21 mounted in the furnace. When a workpiece that does not require over-aging treatment is subjected to heat treatment, the over-aging section may be used as a slow-cooling section.

The product quality is damaged if the surfaces of steel strips are oxidized during annealing treatment. Therefore, in a continuous heat-treatment furnace, the furnace is generally filled with a non-oxidizing atmospheric gas by providing gas feed channels 22*a* to 22*f* and gas discharge channels 23*a* to 23*g* in the individual treatment sections. A mixed gas (HN gas) of hydrogen gas and nitrogen gas has been used generally as the atmospheric gas in the continuous annealing furnace.

In the continuous heat-treatment furnace, different atmospheric gases may be used in adjacent treatment sections in the heating zone or in the cooling zone when heat treatment is performed.

For example, with an aim of improving the aging of low carbon steels, a method is disclosed in Japanese Examined Patent Publication No. 55-1969 or Japanese Unexamined Patent Publication No. 6-346156 in which, in order to increase the cooling rate in the rapid-cooling section before over-aging treatment, the heat-transfer coefficient is improved by increasing the hydrogen content in a cooling gas that is cyclically used in the rapid-cooling section.

In accordance with the processes disclosed in the above patent publications, if an atmospheric gas having a high hydrogen content in the rapid-cooling section leaks into the adjacent slow-cooling section or into the over-aging section, a large amount of hydrogen gas must be fed so that the high hydrogen content in the rapid-cooling section is maintained. Therefore, there is a need for a sealing apparatus which avoids mixture of atmospheric gases having different compositions between the rapid-cooling section and the slow-cooling section and between the rapid-cooling section and the over-aging section.

FIG. 4 is a schematic diagram showing an example of a seal roll apparatus which has been conventionally used for shutting off atmospheric gases in a continuous heat-treatment furnace. As shown in FIG. 4, seal rolls 24*a* and 24*b* are disposed so as to be opposed to each other with a steel strip S therebetween, and a partition 25 is disposed in the vicinity of the seal rolls in order to improve the sealing properties. The steel strip S passes through a space (hereinafter referred to as "a roll gap") between the seal rolls 24*a* and 24*b*. The roll gap is adjusted to be as small as possible to improve the sealing properties, and each seal roll rotates (driven by motors M) so that scratches do not occur on the surfaces of the steel strips even when the travelling steel strip and the rolls are in contact with each other.

As a means for sealing atmospheric gases, an alternative to the seal roll apparatus described above, for example, a bulkhead structure is disclosed in Japanese Unexamined Patent Publication No. 5-125451. The bulkhead structure is disposed at the boundaries between atmospheric gases having different compositions and also functions as a plurality of treatment rooms enabling the feeding and discharging of atmospheric gases having different compositions. A seal roll apparatus is disclosed in Japanese Examined Utility Model Publication No. 63-19316 in which sealing members are disposed so as to be in contact with both surfaces of a steel strip. In Japanese Unexamined Patent Publication No. 59-133330, an apparatus is disclosed in which seal rolls, blowing nozzles, and seal dampers are combined.

However, there are problems in the conventional sealing apparatus as follows.

Although the contact-type sealing apparatus have excellent sealing properties, scratches may occur on the surfaces of the metal strips.

With respect to the gas sealing apparatus, although scratches do not occur on the surfaces of the metal strips because of the non-contact sealing structure, since the sealing gas must always be fed at a certain rate, the consumption of gas is increased. Additionally, in order to maintain sealing properties, the gas feeding must be controlled with high precision, resulting in a high cost of equipment.

In seal roll apparatus in which a steel strip is brought into contact with rotating seal rolls, such drawbacks associated with the above apparatus are not observed. Therefore, such seal roll apparatus are advantageous for practical use. However, since thermal expansion of seal rolls is unavoidable due to radiation heat from the steel strips or furnace walls or due to convective heat transfer through the atmospheric gases, there is a limit to narrowing the roll gap between the seal rolls, and thus atmospheric gases are not sufficiently shut off.

FIGS. 5A through 5C schematically show a seal roll apparatus in which a steel strip S is brought into contact with rotating seal rolls. When seal rolls 24*a* and 24*b* are subjected to radiation heat from the high-temperature steel strip S undergoing annealing and from the furnace wall, thermal expansion having a non-uniform temperature profile (hereinafter referred to as "a thermal crown") is caused in the roll barrel direction of the seal rolls 24*a* and 24*b*. Thus, it is difficult to maintain a minimum gap between the seal rolls 24*a* and 24*b* in the roll barrel direction.

In order to eliminate the effect of the thermal crown, a certain distance must be maintained between the seal rolls and a partition 25 for separating the individual reaction sections.

Moreover, when the roll gap between seal rolls is narrowed, the seal rolls are operated in an attempt to prevent scratches from occurring even if a steel strip and the seal rolls are brought into contact with each other. However, unless the peripheral velocity of the seal rolls and the conveying velocity of the steel strip coincide with each other, scratches unavoidably occur on the surfaces of the steel strip.

The probability of scratches increases as the roll gap between seal rolls is decreased and the opportunity for contact between the seal rolls and the steel strip increases.

Normally, the peripheral velocity of the seal rolls is set to be equal to the value obtained by multiplying a measured rotational frequency of a conveyor roll by a circumference calculated from the diameter of the conveyor roll that has been preliminarily input to a controller. However, since the hearth conveyor roll in the heating zone is subjected to a high-temperature atmosphere, the actual roll diameter is larger than the roll diameter preliminarily input to the controller due to thermal expansion. Therefore, the actual conveying velocity of the steel strip is faster than the set peripheral velocity of seal rolls. The difference between the set seal roll peripheral velocity and the steel-strip conveying velocity increases as the rotational frequency of the hearth conveyor roll is increased, that is, as the conveying velocity is increased.

SUMMARY OF THE INVENTION

In accordance with one aspect of the present invention, a seal roll apparatus that hermetically seals boundaries between a plurality of heat-treating sections for continuously heating and cooling a strip material in a continuous heat-treatment furnace, is provided with at least a pair of water-cooled seal rolls opposed to each other with a gap therebetween for passing the strip material. Preferably, the water-cooled seal rolls are provided in a seal room defined by partitions having an opening for passing the strip material, a partition being provided in each of the inlet side and the outlet side of the seal rolls.

Water-cooling the seal rolls enables the temperatures of the seal rolls to be controlled, enabling them to be placed closer together. The pair of partitions shield the seal rolls from being directly subjected to radiation heat from heat sources and the furnace walls, thus further improving the ability to control the temperature of the seal rolls. This effect is further increased when the partitions are water-cooled.

Consequently, the sealing properties can be improved without causing deterioration in the quality, such as scratches, on the surfaces of the passing strip material.

Moreover, since the seal roll peripheral velocity preferably is set based on the measured surface temperature of a hearth conveyor roll placed very close to the seal rolls, the difference in velocity between the peripheral velocity of the seal rolls and the conveying velocity of the strip material can be reduced substantially to zero, thus avoiding the occurrence of scratches which may lead to deterioration in quality.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
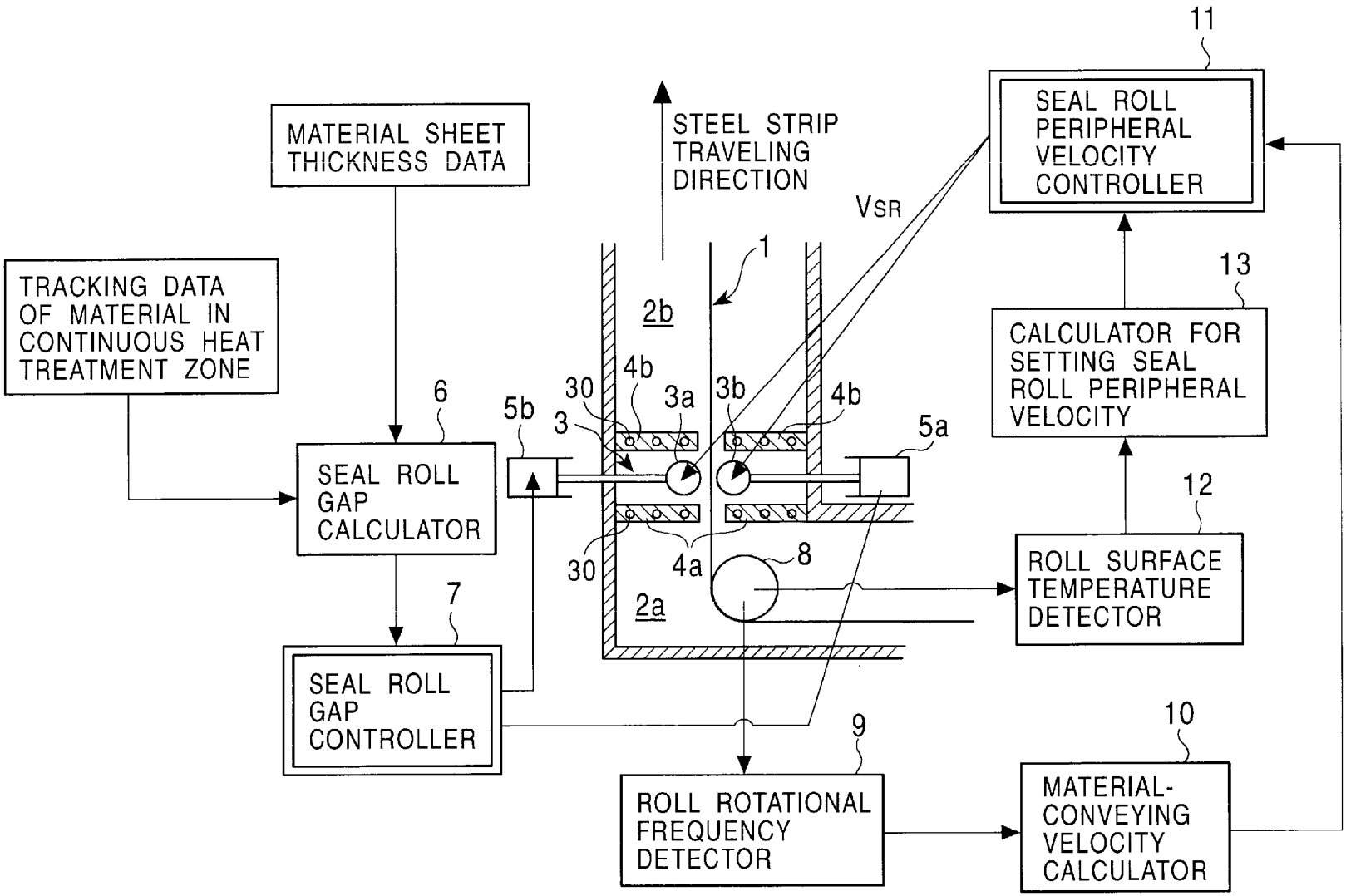
FIG. 1 is a schematic diagram showing a seal roll apparatus in accordance with an embodiment of the present invention.

The present invention provides a novel seal roll apparatus in which the sealing properties are increased without causing scratches that adversely affect the quality of a workpiece.

In accordance with one aspect of the present invention, a seal roll apparatus seals boundaries between heat-treating sections in a continuous heat-treatment furnace provided with a plurality of heat-treating sections for heating and/or cooling a continuously-passed strip material in sequence. The seal roll apparatus includes a seal roll room (or chamber) provided with at least a pair of water-cooled seal rolls opposed to each other with the strip material therebetween and partitions having an opening for passing the strip material, a partition being provided in both the inlet side and the outlet side of the seal rolls.

A peripheral velocity ($V_{SR}$) of the seal rolls may be set in accordance with the following equations:

$$V_{SR}=V_S\times(1+R) \qquad \text{Equation (1)}$$

$$R=A\times\alpha\times T+B$$

where $V_{SR}$ is the set peripheral velocity in meters per minute (mpm) of the seal rolls, $V_s$ is a velocity (mpm) of a hearth conveyor roll placed very close to the seal rolls ($V_S$ is equal to a measured rotational frequency of the hearth conveyor roll placed very close to the seal rolls times (×) a circumference of the conveyor roll measured at room temperature), R is a seal roll peripheral velocity forward slip, T is a surface temperature (° C.) of the hearth conveyor roll placed very close to the seal rolls, α is a coefficient of thermal expansion of the hearth conveyor roll placed very close to the seal rolls, and A and B are constants.

Alternatively, a peripheral velocity ($V_{SR}$) of the seal rolls may be set in accordance with the following equations:

$$V_{SR}=V_S\times(1+R) \qquad \text{Equation (1)}$$

$$R=A\times\alpha\times T+B \qquad \text{Equation (2)}$$

where $V_{SR}$ is the set value of a peripheral velocity (mpm) of the seal rolls, $V_S$ is a velocity (mpm) of a hearth conveyor roll placed very close to the seal rolls ($V_S$is equal to a measured rotational frequency of the hearth conveyor roll placed very close to the seal rolls × a circumference of the conveyor roll measured at room temperature), R is a seal roll peripheral velocity forward slip, T is a temperature (° C.) of the strip material very close to the hearth conveyor roll placed very close to the seal rolls, α is a coefficient of thermal expansion of the hearth conveyor roll placed very close to the seal rolls, and A and B are constants.

The seal rolls may be provided with a roll gap adjuster for changing the roll gap in response to the thickness of the strip material.

In one embodiment of the present invention, for example, since a seal roll room is formed by disposing a partition both at the inlet side and at the outlet side of seal rolls, the seal rolls are not directly subjected to radiation heat from heat sources and furnace walls.

In the seal rolls of embodiments of the present invention, for example, channels are provided in shells of the rolls, and the rolls are cooled by continuously passing cooling water through the channels. Thus, thermal expansion of the rolls due to radiation heat from the steel strip passing through the rolls is suppressed. Consequently, since the thermal crown is reduced and non-uniform thermal expansion of the seal rolls in the roll barrel direction does not occur during the continuous annealing operation, a smaller roll gap between the seal rolls can be stably maintained in comparison with the conventional apparatus. Since the distances between the seal rolls and the partitions do not vary greatly during operation, the distances can be decreased, thus improving the sealing properties.

Moreover, since the set peripheral velocity of the seal rolls is calculated after an increase in the hearth conveyor roll diameter is compensated for using either the surface temperature of the hearth conveyor roll placed very close to the seal rolls or the temperature of the strip material very close to the hearth conveyor roll, slipping does not occur between the seal rolls and the strip material, and the distances between the seal rolls and the strip material can be shortened.

When a seal roll apparatus is used in a higher-temperature atmosphere, in addition to the deformation of the seal rolls due to thermal expansion, the heat deformation of partitions may give rise to a problem. In such a case, the heat deformation may be prevented by constructing water-cooled partitions, for example, using water cooling tube 30 in the partitions as shown in FIG. 1.

The present invention will be described in more detail with reference to the drawings.

FIG. 1 is a schematic diagram showing a seal roll apparatus in accordance with one embodiment of the present invention. Numeral 1 represents a strip material (steel strip) to be heat-treated, numerals 2*a* and 2*b* represent passages for connecting adjacent heat-treating sections, and numeral 3 represents a seal roll apparatus disposed between the passages 2*a* and 2*b*. The seal roll apparatus 3 is provided with water-cooled seal rolls 3*a* and 3*b*. Partitions 4*a* and 4*b* are provided with an opening for passing the material 1, and are disposed at the inlet side and at the outlet side of the seal rolls 3*a* and 3*b*, respectively, to constitute (define) a seal roll room (or chamber). Numerals 5*a* and 5*b* represent roll gap adjusters for adjusting a roll gap between the seal rolls 3*a* and 3*b*. Hydraulic cylinders or the like may be used as the roll gap adjusters 5*a* and 5*b*. The roll gap between the seal rolls 3*a* and 3*b* is calculated by a seal roll gap calculator 6 based on the sheet thickness data of the material 1 and the tracking data of the material in a continuous heat-treatment furnace, and in accordance with the calculation, a seal roll gap controller 7 drives the roll gap adjusters 5*a* and 5*b*.

Numeral 8 represents a hearth conveyor roll. A roll rotational frequency detector 9 detects the rotational frequency of the hearth conveyor roll 8. A material-conveying velocity calculator 10 calculates the conveying velocity of the material based on the rotational frequency of the hearth conveyor roll 8. A seal roll peripheral velocity controller 11 controls the peripheral velocity of the seal rolls, and the values calculated by the material-conveying velocity calculator 10 are output to the controller 11. A roll surface temperature detector 12 detects the surface temperature of the hearth conveyor roll 8. A calculator 13 calculates a set peripheral velocity of the seal rolls 3*a* and 3*b* based on the detected temperature (detected by detector 12), and the calculated value is output to the controller 11.

If there is a difference in velocity between the peripheral velocity of the seal rolls 3*a* and 3*b* and the conveying velocity of the material (steel strip) 1, it is not possible to avoid the occurrence of scratches on the front and back surfaces of the material 1. Therefore, according to one aspect of the present invention, a peripheral velocity $V_{SR}$ of the seal rolls is set in accordance with the following equations (1) and (2) so that the difference in velocity approximates zero.

$$V_{SR}=V_S\times(1+R) \quad \text{Equation (1)}$$

$$R=A\times\alpha\times T+B \quad \text{Equation (2)}$$

where $V_{SR}$ is the set peripheral velocity (mpm) of the seal rolls, $V_S$ is a velocity (mpm) of a hearth conveyor roll placed very close to the seal rolls ($V_S$ is equal to a measured rotational frequency of the hearth conveyor roll placed very close to the seal rolls × a circumference of the conveyor roll measured at room temperature), R is a seal roll peripheral velocity forward slip, T is a surface temperature (° C.) of the hearth conveyor roll placed very close to the seal rolls, α is a coefficient of thermal expansion of the hearth conveyor roll placed very close to the seal rolls, and A and B are constants.

The parameter R in the equation (1) is a seal roll peripheral velocity forward slip, and by adding the value derived from equation (2) to the peripheral velocity, the difference in velocity between the peripheral velocity of the seal rolls and the conveying velocity of the material can be reduced substantially to zero.

In order to enhance the sealing properties by continuously maintaining a given distance between the seal rolls and the material, the roll gap between the seal rolls may be adjusted by the adjusters 5*a* and 5*b* in response to the sheet thickness of the material, using the material sheet thickness data and the tracking data of the passing material.

An embodiment will be described in which a seal roll apparatus in accordance with the present invention is applied to a continuous annealing furnace for a cold-rolled steel strip and high-concentration hydrogen gas is used in the rapid-cooling section.

In the continuous heat-treatment furnace, an atmospheric gas having a high hydrogen concentration (hydrogen 40 vol %, the remainder being nitrogen) is used in the rapid-cooling section and a low hydrogen-concentration gas (hydrogen 4 vol %, the remainder being nitrogen) is used in the other sections. At the inlet and outlet of a rapid cooling section, the high hydrogen-concentration gas used in the rapid-cooling section must be prevented from leaking. Although the high hydrogen-concentration gas is cyclically used in the rapid-cooling section, if a leakage of hydrogen gas from the seal roll apparatus is increased, a large amount of hydrogen gas must be fed in order to maintain the high hydrogen concentration in the rapid-cooling section. Thus, excellent sealing properties are required.

In an example of the present invention, the operational conditions were as follows:

Continuous heat-treatment furnace: continuous annealing furnace for a cold-rolled steel strip in which high hydrogen-concentration gas was used in the rapid-cooling section.

Installation of seal roll apparatus: a seal roll apparatus having a structure as shown in FIG. 1 was placed at the boundary between the slow-cooling section and the rapid-cooling section.

Size of steel strip:
thickness at 0.8 mm
width at 1,200 mm
Temperature of steel strip at the outlet of the heating section:
780° C.
Steel strip-conveying velocity:
300 mpm
Hearth conveyor roll diameter:
1,200 mm
Seal roll diameter:
300 mm (water-cooled)
Seal roll gap:
4.8 mm
Distance between seal roll and partition:
2.0 mm The surface temperature of the steel-strip conveyor roll placed very close to the seal rolls was measured with a thermocouple embedded in the surface of the roll. In place of the thermocouple, for example, a radiation thermometer may be used.

In order to observe the temperature profile of the seal roll surface when the steel strip was continuously passed under the operational conditions described above, a thermocouple was embedded in the surface of the seal roll to measure the temperature. With respect to a conventional seal roll (without water-cooling; with a diameter of 300 mm and other conditions the same as the above), the temperature profile of the seal roll surface was also obtained as a comparative example.

Figure 2:
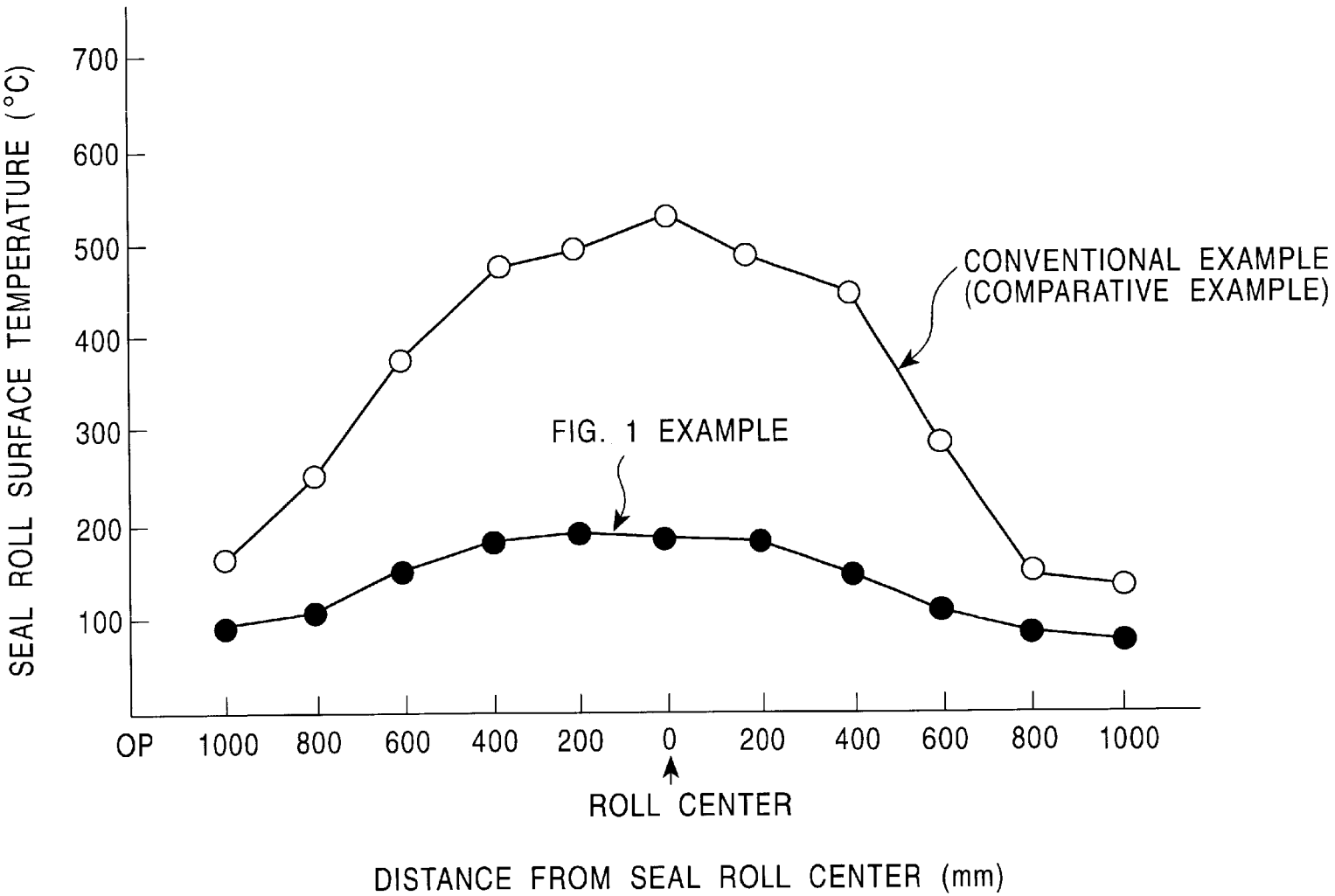
FIG. 2 is a graph that compares the seal roll surface temperature in the present invention with that in a conventional example.
Figure 3:
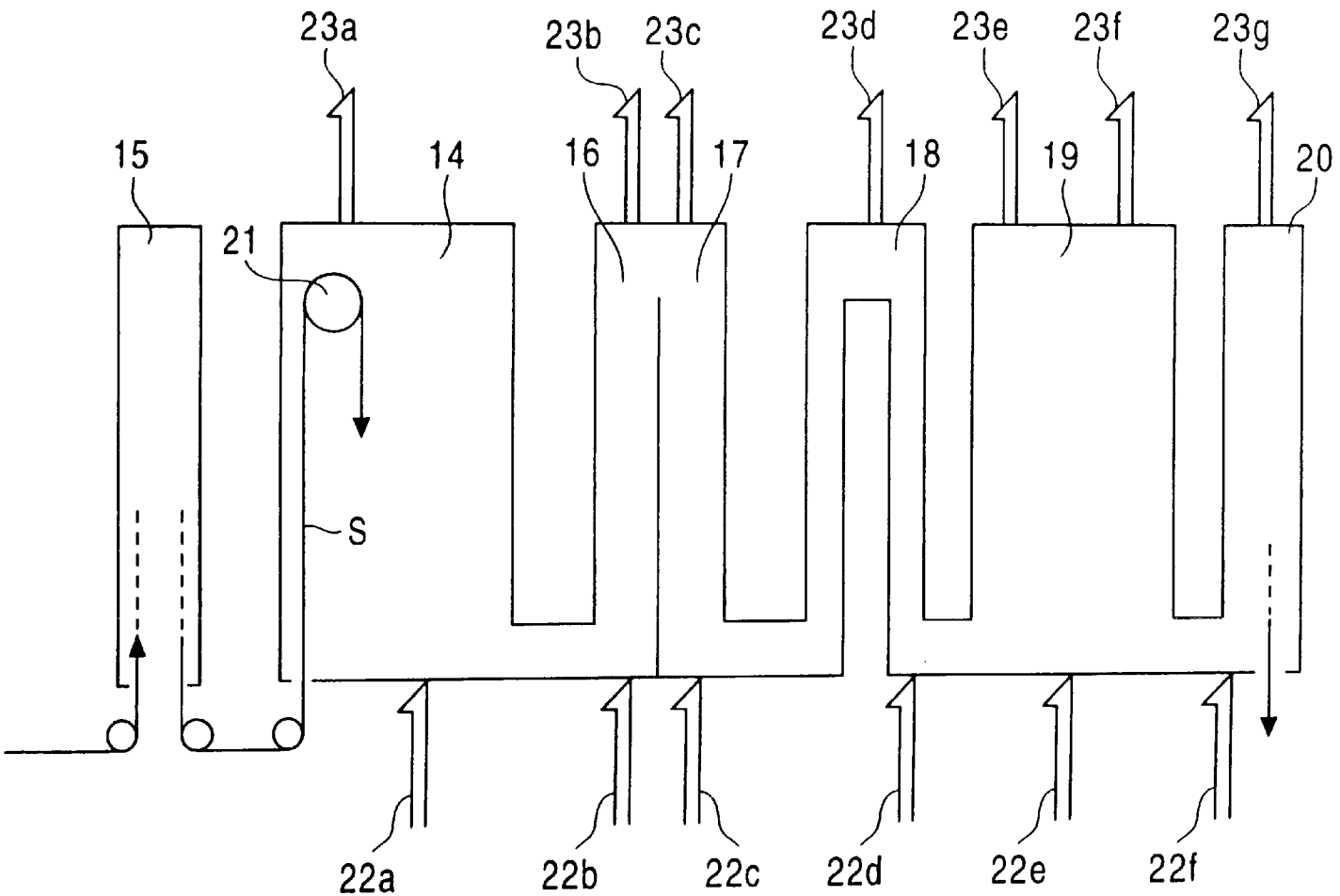
FIG. 3 Prior Art
FIG. 3 is a diagram showing a structure of a continuous heat-treatment furnace.
Figure 4:
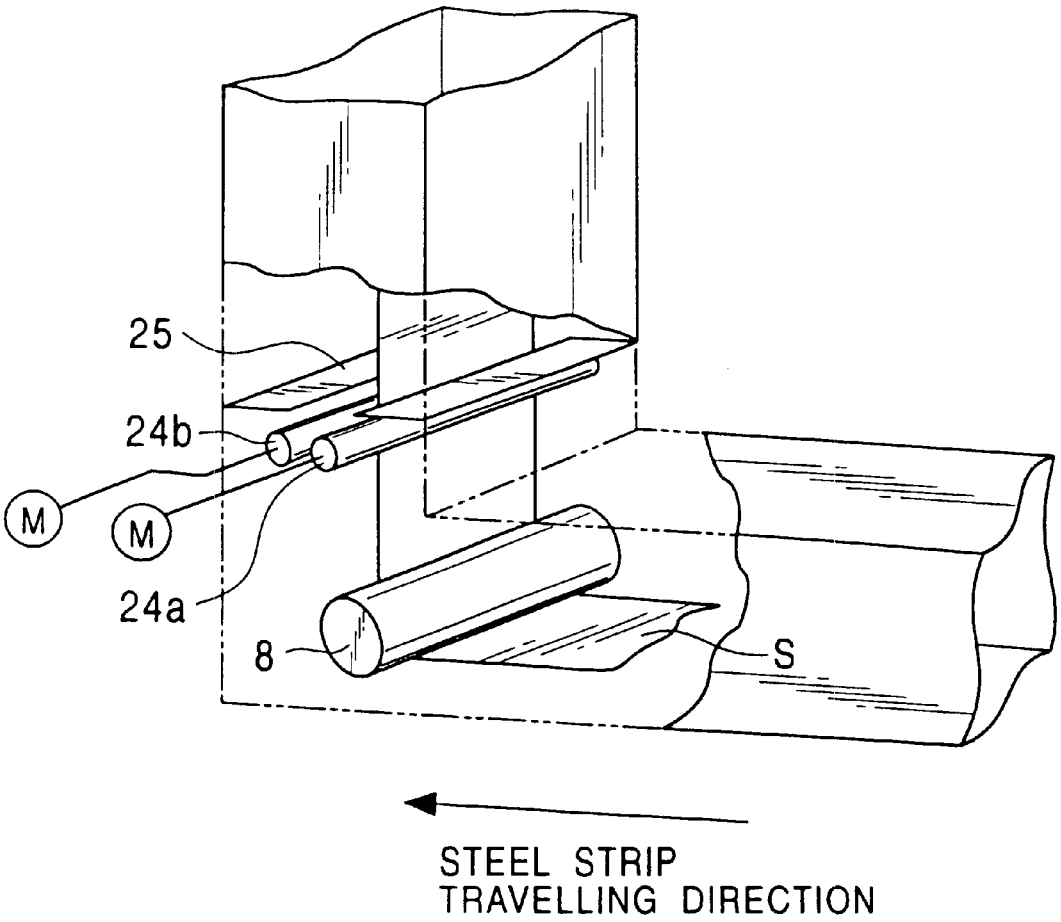
FIG. 4 Prior Art
FIG. 4 is a schematic diagram of a conventional seal roll apparatus.
Figure 5A:
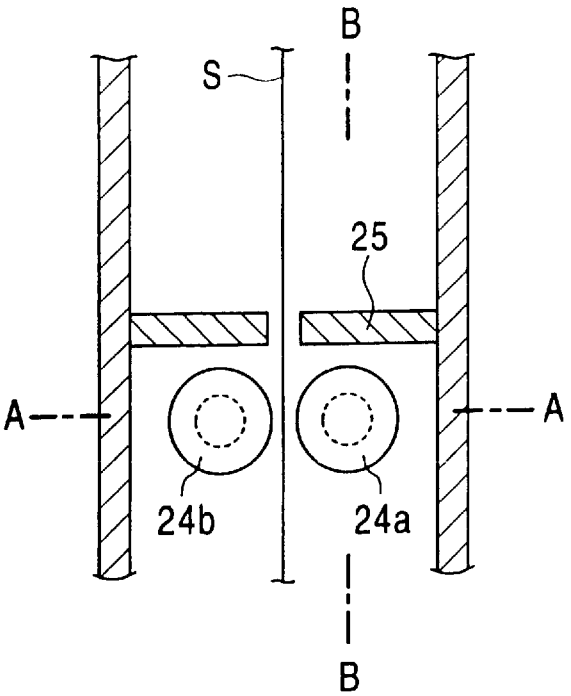
Prior Art FIG. 5A
FIGS. 5A through 5C illustrate the state in which thermal crowns occur in seal rolls.
Figure 5B:
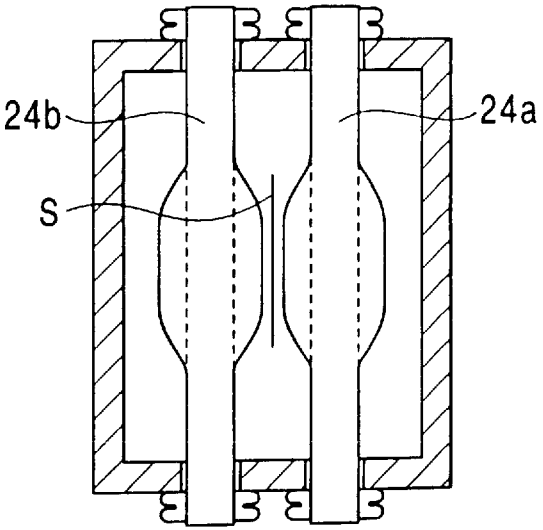
Prior Art FIG. 5B
Figure 5C:
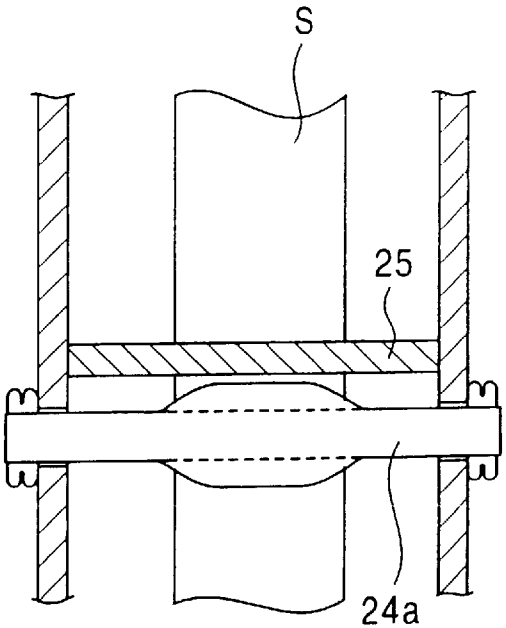
Prior Art FIG. 5C

FIG. 2 shows the results of the measurements. As is clear from the graph, in the water-cooled seal roll, the thermal crown is decreased because the roll temperature is decreased by approximately 350° C. at maximum (resulting in an approximately 2 mm difference in the roll diameter) in comparison with the conventional seal roll without water-cooling.

In order to confirm the effect of setting the seal roll peripheral velocity forward slip, the presence or absence of scratches on the surfaces of steel strips was investigated both in the case of setting the seal roll peripheral velocity while taking the forward slip into account in accordance with the present invention, and in the case of setting the seal roll peripheral velocity without taking the forward slip into account as had been done conventionally. In each case, the seal roll gap was set at 4.8 mm, and the ratio of the total length of scratches to the total length of the steel strip was observed. In the conventional case, the rate of scratch occurrence was 0.43% (86 m: 20,000 m). In the case according to an embodiment of the present invention, no scratch was observed.

That is, when a seal roll gap is narrowed by using water-cooled seal rolls, the probability of contact between a steel strip and the seal rolls increases, and thus, if there is a difference between the seal roll peripheral velocity and the steel-strip conveying velocity, scratches occur on the surfaces of the steel strip. On the other hand, in accordance with one aspect of the present invention, since the seal roll peripheral velocity is set in consideration of thermal expansion of the steel-strip conveying roll placed very close to the seal rolls (in accordance with equations (1) and (2)), the difference in velocity between the peripheral velocity of the seal rolls and the conveying velocity of the steel strip can be reduced substantially to zero, and as a result, the rate of scratch occurrence can be zero.

In the continuous heat-treatment furnace using an atmospheric gas having a high hydrogen content hydrogen 40 vol %, the remainder being nitrogen) in the rapid-cooling section and an atmospheric gas having a low hydrogen content (hydrogen 4 vol %, the remainder being nitrogen), the consumption of hydrogen gas can be reduced approximately to half of that in the conventional seal roll apparatus without water-cooling, with a seal roll gap of 12.0 mm, in which a seal roll peripheral velocity forward slip is not set. Thus, the consumption of hydrogen gas in the continuous heat-treatment furnace provided with the rapid-cooling section using a high hydrogen-concentration gas can be significantly reduced.

In the example, although the surface temperature T of the hearth conveyor roll placed very close to the seal rolls is used when the seal roll peripheral velocity forward slip is calculated in consideration of the thermal expansion of the hearth conveyor roll, as the temperature T, as an alternative, the temperature of the steel strip measured very close to the hearth conveyor roll may be used. The reason for this is that in view of the state of the steel strip placed around the hearth conveyor roll and the high thermal conductivity of the metal, the surface temperature of the hearth conveyor roll and the temperature of the strip material in contact with the hearth conveyor roll are considered to be substantially the same. Therefore, even if there is no means for directly measuring the surface temperature of the hearth conveyor roll, by measuring the temperature of the steel strip with a radiation thermometer or the like, a peripheral velocity of the seal rolls can be calculated in accordance with an aspect of the present invention.

In order to enhance the sealing properties by narrowing the seal roll gap, the seal roll gap must be controlled with precision in response to the thickness of the passing steel strip. In accordance with an aspect of the present invention, an adjuster is provided for adjusting the seal roll gap. For that purpose, an electric motor, e.g., may be used as an actuator.

Although the seal roll apparatus in accordance with the present invention used for a continuous heat-treatment furnace provided with the rapid-cooling section using high hydrogen-concentration gas has been described, the present invention may also be applied to a continuous annealing furnace for hot-dip galvanized steel sheets in which annealing atmospheres can be controlled. In such a process, activation treatment by annealing is performed on the surfaces of steel sheets before coating in an oxidizing atmosphere and reduction treatment by annealing is performed in a reducing atmosphere so that the adhesiveness of coating is improved after annealing. By mounting a seal roll apparatus in accordance with the present invention at the boundary between the oxidizing atmosphere section and the reducing atmosphere section, annealing treatments having completely different atmospheres can be continuously performed.

In the present invention, with respect to a seal roll apparatus used for a continuous heat-treatment furnace or the like, since a seal roll room preferably is formed by disposing a partition both at the inlet side and at the outlet side of seal rolls and the seal rolls are water-cooled, thermal crowns of the seal rolls due to radiation heat from steel strips and furnace walls can be greatly decreased.

Since a peripheral velocity of seal rolls is set based on the measured surface temperature of a hearth conveyor roll placed very close to the seal rolls, the difference between the peripheral velocity of the seal rolls and the steel-strip conveying velocity can be reduced substantially to zero, thus avoiding the occurrence of scratches which lead to a deterioration in quality.

Because of the two factors described above, namely, the water-cooled seal rolls and the properly calculated peripheral velocity of the seal rolls, the roll gap between seal rolls can be reduced to approximately 5 mm in contrast with the conventional roll gap of approximately 12 to 15 mm. The distances between the seal rolls and the partitions can also be reduced to 2.0 mm. As a result, the performance of the seal roll apparatus is significantly improved.

While the present invention has been described with reference to preferred embodiments thereof, it is to be understood that the invention is not limited to the disclosed embodiments or constructions. To the contrary, the invention is intended to cover various modifications and equivalent arrangements. In addition, while the various elements of the disclosed invention are shown in various combinations and configurations, which are exemplary, other combinations and configurations, including more, less or only a single element, are also within the spirit and scope of the invention

What is claimed is:

1. A seal roll apparatus for sealing boundaries between a plurality of heat-treating sections for continuously heating and cooling a strip material in a continuous heat-treatment furnace, the seal roll apparatus comprising:

a seal roll room including partitions having an opening for passing the strip material, one of the partitions provided at an inlet side of the seal roll room and another one of the partitions provided at an outlet side of the seal room, and at least a pair of fluid-cooled seal rolls that are opposed to each other with a gap therebetween for passing the strip material in the seal roll room between the partitions, wherein said seal rolls each rotate symmetrically about an axis and the gap is larger than a thickness of the strip material.

2. A seal roll apparatus according to claim 1, further comprising a roll gap adjuster that changes a size of the gap between the seal rolls in response to the thickness of the strip material.

3. A seal roll apparatus according to claim 1, wherein at least one of the partitions is fluid-cooled.

4. A seal roll apparatus for sealing boundaries between a plurality of heat-treating sections for continuously heating and cooling a strip material in a continuous heat-treatment furnace, the seal roll apparatus comprising:

a seal roll room including partitions having an opening for passing the strip material, one of the partitions provided at an inlet side of the seal roll room and another one of the partitions provided at an outlet side of the seal roll room, at least a pair of fluid-cooled seal rolls that are opposed to each other with a gap therebetween for passing the strip material in the seal roll room between the partitions, wherein said seal rolls each rotate symmetrically about an axis, and a controller that sets and controls a peripheral velocity ($V_{SR}$) of the seal rolls in accordance with the following equations:

$$V_{SR}=V_S\times(1+R) \quad \text{Equation (1)}$$

$$R=A\times\alpha\times T+B \quad \text{Equation (2)}$$

where $V_{SR}$ is a set peripheral velocity (mpm) of the seal rolls, $V_S$ is a velocity (mpm) of a hearth conveyor roll placed close to the seal rolls ($V_S$ is equal to a measured rotational frequency of the hearth conveyor roll times a circumference of the hearth conveyor roll measured at room temperature), R is a seal roll peripheral velocity forward slip, T is a surface temperature (° C.) of the hearth conveyor roll, $\alpha$ is a coefficient of thermal expansion of the hearth conveyor roll, and A and B are constants.

5. A seal roll apparatus for sealing boundaries between a plurality of heat-treating sections for continuously heating and cooling a strip material in a continuous heat-treatment furnace, the seal roll apparatus comprising:

a seal roll room including partitions having an opening for passing the strip material, one of the partitions provided at an inlet side of the seal roll room and another one of the partitions provided at an outlet side of the seal roll room, at least a pair of fluid-cooled seal rolls that are opposed to each other with a gap therebetween for passing the strip material in the seal roll room between the partitions, wherein said seal rolls each rotate symmetrically about an axis, and a controller that sets and controls a peripheral velocity ($V_{SR}$) of the seal rolls in accordance with the following equations:

$$V_{SR}=V_S\times(1+R) \quad \text{Equation (1)}$$

$$R=A\times\alpha\times T+B \quad \text{Equation (2)}$$

where $V_{SR}$ is a set peripheral velocity (mpm) of the seal rolls, $V_S$ is a velocity (mpm) of a hearth conveyor roll placed close to the seal rolls ($V_S$ is equal to a measured rotational frequency of the hearth conveyor roll times a circumference of the hearth conveyor roll measured at room temperature), R is a seal roll peripheral velocity forward slip, T is a temperature (° C.) of the strip material close to the hearth conveyor roll, $\alpha$ is a coefficient of thermal expansion of the hearth conveyor roll, and A and B are constants.

6. A furnace incorporating the seal roll apparatus according to claim 1, wherein the seal roll room is positioned within the furnace between two of the plurality of heat-treating sections.

7. A continuous heat-treatment furnace incorporating a seal roll apparatus according to claim 1.

8. A method for sealing a continuous heat-treatment furnace, comprising the steps of:

sealing boundaries between a plurality of heat-treating sections in the continuous heat-treatment furnace by locating at least one pair of rotating, fluid-cooled seal rolls that are opposed to each other with a gap therebetween for passing the strip material in a seal roll room including partitions having an opening for passing strip material, one of the partitions provided at an inlet side of the seal roll room and another one of the partitions provided at an outlet side of the seal roll room, wherein said seal rolls each rotate symmetrically about an axis and the gap is larger than a thickness of the strip material.

9. A method according to claim 8, further comprising adjusting a size of the gap between the seal rolls in response to the thickness of the strip material.

10. A method according to claim 8, further comprising fluid-cooling at least one of the partitions.

11. A method for sealing a continuous heat-treatment furnace, comprising the steps of:

sealing boundaries between a plurality of heat-treating sections in the continuous heat-treatment furnace by locating at least one pair of rotating, fluid-cooled seal rolls in a seal roll room including partitions having an opening for passing strip material, one of the partitions provided at an inlet side of the seal roll room and another one of the symmetrically about an axis, and setting and controlling a peripheral velocity ($V_{SR}$) of the seal rolls in accordance with the following equations:

$$V_{SR}=V_S\times(1+R) \quad \text{Equation } (1)$$

$$R=A\times\alpha\times T+B \quad \text{Equation } (2)$$

where $V_{SR}$ is set peripheral velocity (mpm) of the seal rolls, $V_S$ is a velocity (mpm) of a hearth conveyor roll placed close to the seal rolls ($V_S$ is equal to a measured rotational frequency of the hearth conveyor roll times a circumference of the hearth conveyor roll measured at room temperature), R is a seal roll peripheral velocity forward slip, T is a surface temperature (° C.) of the hearth conveyor roll, $\alpha$ is a coefficient of thermal expansion of the hearth conveyor roll, and A and B are constants.

12. A method for sealing a continuous heat-treatment furnace, comprising the steps of:

sealing boundaries between a plurality of heat-treating sections in the continuous heat-treatment furnace by locating at least one pair of rotating, fluid-cooled seal rolls in a seal roll room including partitions having an opening for passing strip material, one of the partitions provided at an inlet side of the seal roll room and another one of the partitions provided at an outlet side of the seal roll room, the seal rolls each rotating symmetrically about an axis, and setting and controlling a peripheral velocity ($V_{SR}$) of the seal rolls in accordance with the following equations:

$$V_{SR}=V_S\times(1+R) \quad \text{Equation } (1)$$

$$R=A\times\alpha\times T+B \quad \text{Equation } (2)$$

where $V_{SR}$ is a set peripheral velocity (mpm) of the seal rolls, $V_S$ is a velocity (mpm) of a hearth conveyor roll placed close to the seal rolls ($V_S$ is equal to a measured rotational frequency of the hearth conveyor roll times a circumference of the hearth conveyor roll measured at room temperature), R is a seal roll peripheral velocity forward slip, T is a temperature (° C.) of the strip material close to the hearth conveyor roll, $\alpha$ is a coefficient of thermal expansion of the hearth conveyor roll, and A and B are constants.

* * * * *